United States Patent [19]

Thompson

[11] Patent Number: 4,982,540

[45] Date of Patent: Jan. 8, 1991

[54] TRIM PIECE FOR SUSPENDED CEILINGS

[76] Inventor: Roger L. Thompson, 25621 Dillon Rd., Laguna Hills, Calif. 92653

[21] Appl. No.: 398,634

[22] Filed: Aug. 25, 1989

[51] Int. Cl.[5] ..... E04B 5/57

[52] U.S. Cl. ..... 52/287; 52/716

[58] Field of Search ..... 52/416, 417, 716.1, 52/364, 287, 288, DIG. 4, 241, 236.9

[56] References Cited

U.S. PATENT DOCUMENTS

| | | | |
|---|---|---|---|
| 2,843,889 | 7/1958 | Keller | 52/716 |
| 3,206,806 | 9/1965 | Powell | 52/287 |
| 3,292,328 | 12/1966 | Lewis et al. | 52/DIG. 4 |
| 4,074,478 | 2/1978 | Rutherford | 52/288 |
| 4,087,944 | 5/1978 | Mecklenburg | 52/241 |
| 4,555,885 | 12/1985 | Raymond et al. | 52/288 |
| 4,587,781 | 5/1986 | Uttley et al. | 52/242 |
| 4,598,516 | 7/1986 | Groshong | 52/417 |
| 4,624,087 | 11/1986 | Schneller | 52/716 |

FOREIGN PATENT DOCUMENTS 225583 3/1969 Sweden .

OTHER PUBLICATIONS

Advertisement for L-Speed Bead, Beadex Mfrg. Co., Inc., from *Construction Dimensions,* 2/87, 2 pgs.

*Primary Examiner*—James L. Ridgill, Jr.

*Attorney, Agent, or Firm*—Knobbe, Martens, Olson & Bear

[57] ABSTRACT

A trim piece including a generally horizontal capping flange insertable into a gap between a wallboard partition and a ceiling panel, a generally horizontal trim flange having a painted lower surface which extends away from the partition along the ceiling panel and a stem which extends downward over the front surface of the partition. The trim flange extends outwardly at an obtuse angle from the stem at approximately 180° from the capping flange. When the capping flange is inserted into the gap between the wallboard partition and the ceiling flange, the capping flange is driven against the top surface of the wallboard partition, and the outer end of the trim piece is driven upward against the bottom surface of the ceiling panel to cover the gap from view. The junction of the upper layer of the capping flange and the trim flange is at least as strong as the trim flange itself so that any tendency of the junction to bend or buckle will be minimized. Another aspect of the invention is the use of a removable protective strip to cover the painted lower surface of the trim flange during installation. Another aspect of the invention is a method of covering a gap between a substantially vertical wallboard partition and a substantially horizontal ceiling panel with a trim piece.

6 Claims, 2 Drawing Sheets

TRIM PIECE FOR SUSPENDED CEILINGS

BACKGROUND OF THE INVENTION

This invention relates generally to ceiling trim systems and, in particular, to trim pieces for installation between the gaps formed between suspended ceilings and drywall partitions.

Suspended ceilings are typically constructed by suspending a series of main T-bars and cross T-bars from the main structural ceiling by hanger wires so as to form an overhead grid. Rectangular ceiling panels are then inserted into each section of the grid where they are supported by the horizontal flanges of the T-bars. This mode of construction is advantageous in that it permits the ceiling panels to be easily removed to provide access to the main structural ceiling for maintenance.

After the ceiling is installed, drywall partitions are cut to size and erected by means of fastening the partitions to metal studs or channels secured to the floor and the T-bar grid work. Since the partitions are secured below the flanges of the T-bars and the ceiling tiles rest on top of the flanges of the T-bars, this method of construction results in an aesthetically undesirable gap, at least as wide as the thickness of the flanges of the T-bars, being formed between the partitions and the ceiling tiles between each pair of T-bars. This problem and the installation process are described in detail by U.S. Pat. No. 4,587,781, which patent is hereby incorporated by reference.

U.S. Pat. No. 4,074,478 teaches the use of a drywall casing bead, having a removable tear strip. The bead is comprised of a first, vertical strip joined to a second strip so that the first and second strip form an acute included angle, with the junction between the first and second strip forming an elongate lip which provides a margin for the accumulation of masking material. A removable tear strip is joined to the second strip along a scored and weakened line so as to form a 90° angle with the vertical first strip. When the tear strip is removed, an unattractive space is left between the elongate lip and the ceiling part with only the torn edged second strip extending there between. Due to the normal irregularities in the height of the wallboard partition, in the height of the ceiling grid and in the level of the floor, the height of this gap will generally vary widely along the length of the partition.

U.S. Pat. No. 4,587,781 teaches the use of a generally T-shaped trim piece including a tongue portion and a flange element to both cover the gap between wallboard partition and the ceiling panel and to provide an aesthetically pleasing trim strip along the upper edge of the partition. When installed, the tongue portion extends between the channel support behind the partition and the rear of the partition. The substantially longer trim flange element, which is substantially the same thickness as the flanges of the T-bars, extends from behind the partition at a 90° angle to the tongue portion through the gap along the underside of the ceiling tile beyond the wallboard.

This trim piece is also insufficient to cover a gap between a wallboard partition and a ceiling panel due to the normal irregularities in the height of the wallboard partition, the ceiling grid and the level of the floor which vary the size of the gap to fill. Furthermore, this trim piece suffers from a number of additional shortcomings. First, the trim piece provides no suitable guide for the worker trowel or brush, thereby increasing the likelihood that paint or joint compound will be splattered on the trim flange. Second, any paint and/or joint compound which is splattered, must be scrubbed from the trim piece after the trim piece has been installed, a relatively difficult and time consuming task. Third, the trim piece cannot be removed to be refinished or replaced without tearing down the drywall partition.

Thus, there is needed an improved trim piece for suspended ceilings which is adapted to cover the wide variety of uneven gaps generally present between the wallboard partition and the ceiling panel, overcoming the drawbacks of past devices.

SUMMARY OF THE INVENTION

The trim piece of the present invention provides a generally horizontal capping flange insertable into a gap between a wallboard partition and a ceiling panel, a generally horizontal trim flange having a painted lower surface which extends away from the partition along the ceiling panel and a stem which extends downward over the front surface of the partition. The trim flange extends outward at an obtuse angle from the stem at approximately 180° from the capping flange. When the capping flange is inserted into the gap between the wallboard partition and the ceiling flange, the capping flange is driven against the top surface of the wallboard partition, and the outer end of the trim piece is driven upward against the bottom surface of the ceiling panel to cover the gap from view.

A significant feature of the present invention is that the junction of the upper layer of the capping flange and the trim flange is at least as strong as the trim flange itself so that any tendency of the junction to bend or buckle will be minimized. This is important because, as discussed above, the size of the gap between the wallboard partition and the ceiling panel varies over the length of the partition. Accordingly, in places, there will be significant downward force against the raised shoulder at the outer end of the trim flange, yet the trim flange must resist permanent bending or buckling so that the trim flange will extend upward to form an obtuse included angle with the exposed vertical outer surface of the wallboard partition to fully cover the gap where the ga is wider.

A significant aspect of the present invention is the use of at least one, and preferably two, raised beads between the upper and lower ends of the stem for purposes of increasing the rigidity and strength of the stem and increasing the capacity of the trim piece to resist bending and twisting moments.

Another aspect of the invention is the trim piece's use of the resilient lip between the capping flange and the stem to pull the lower end of the stem against the wallboard partition to form an acute angle between the stem and the wallboard partition. This angle is significant in that it facilitates the application of a thicker layer of masking compound over the stem through the use of the lip and the outer surface of the wallboard partition as guides for a workpiece, so that the stem and any fasteners utilized to secure the stem to the wallboard partition are completely covered by masking compound. Furthermore, when the stem is provided with a series of apertures spaced above the lower end of the stem, this angle has the effect of spacing the stem from the wallboard partition, permitting masking compound to seep into the space between the stem and the vertical outer surface of the wallboard partition to better anchor the masking compound to the trim piece.

Another advantage of the present invention is the use of a protective strip to cover the painted lower surface of the trim flange during installation.

Another aspect of the invention is a method of covering a gap between a substantially vertical wallboard partition and a substantially horizontal ceiling panel with a trim piece including a stem positioned between and below a capping flange and a trim flange so that the stem forms an obtuse angle with the trim flange. The trim piece further includes a protective strip covering the lower surface of the trim flange. The method includes the insertion of the capping flange of the trim piece into the gap between the ceiling panel and the wallboard partition. The stem of the trim piece is fastened to the vertical outer surface of the wallboard partition so that the stem forms an acute angle with the vertical outer surface of the wallboard partition, and the trim flange presses against the horizontal bottom surface of the ceiling panel. The stem is masked and the protective strip is removed from the painted lower surface of the trim flange to expose substantially the entire lower surface of the trim flange.

DESCRIPTION OF THE DRAWINGS

Further features and advantages of the invention will become apparent with reference to the following drawings, in which.

DETAILED DESCRIPTION OF THE PREFERRED EMBODIMENT

Figure 1:
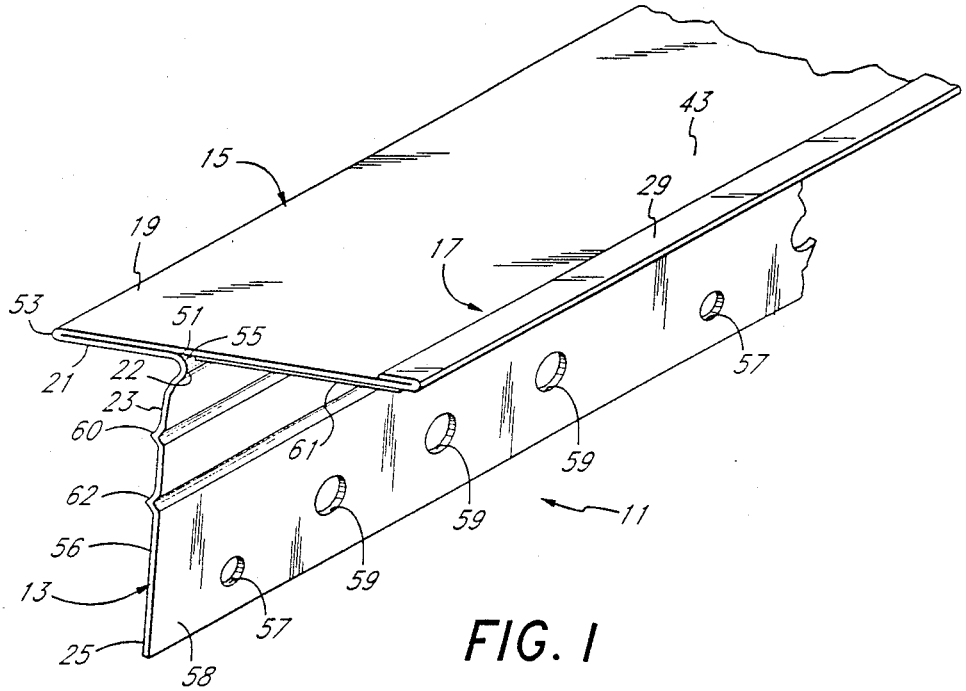
FIG. 1 is a perspective view of a trim piece in accordance with principles of the invention.
Figure 3:
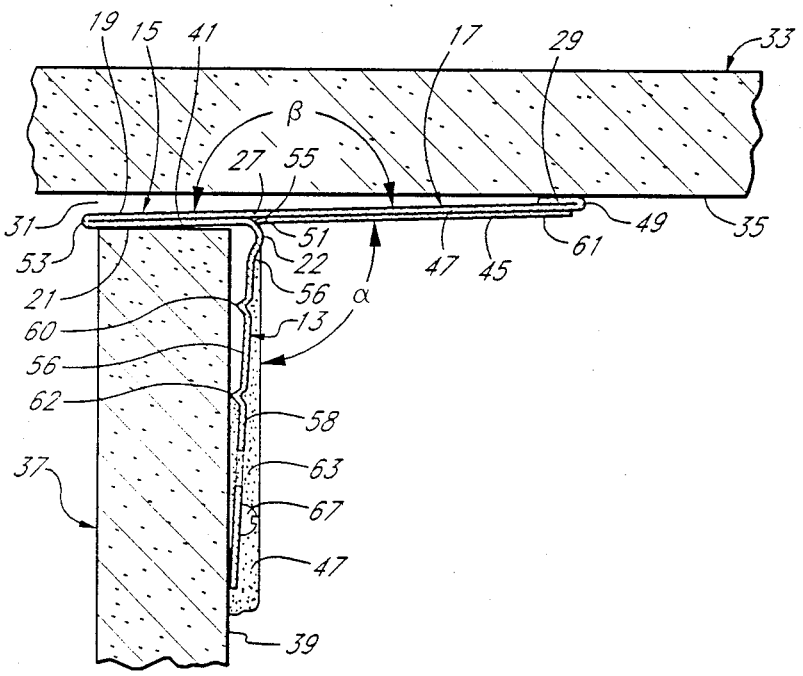
FIG. 3 is a side view of the trim piece of FIG. 1 as installed.

Referring to FIGS. 1 and 3, there is shown an elongate generally T-shaped trim piece 11 including a generally vertical stem 13, a generally horizontal capping flange 15, and a generally horizontal trim flange 17. The stem 13 is approximately twice the length of the capping flange 15, and approximately 1 1/7 the length of the trim flange 17. Thus, the trim flange 17 is of a substantially greater length, i.e., about 1 ½ to 2 times greater, than the capping flange 15. The capping flange 15 is formed by an upper layer 19 and a lower layer 21. The lower layer 21 is joined to the stem 13 by an elongate horizontal lip 22. The stem 13 has an upper end 23 integrally joined to the lip 22 and a free, lower, distal end 25 extending downward away from the capping flange 15 and the trim flange 17. The upper layer 19 of the capping flange 15 is integrally joined to the trim flange 17 along a line or junction 27 immediately above the lip 22, with the upper end 23 of the stem 13 being positioned below and between the trim flange 17 and the capping flange 15. At the end of the trim flange 17 opposite the capping flange 15 is a short raised shoulder 29. The trim flange 17 extends outward at an angle $\alpha$ of approximately 95° from the stem 13 and at an angle $\alpha$ of approximately 180° from the capping flange 15. These angles are an important aspect of the invention, because they enable the trim piece 11 to cover wider gaps between a wallboard partition and a ceiling panel, and facilitate the masking of the stem 13, as will be described in greater detail below.

As illustrated in FIG. 3, the capping flange 15 of the trim piece 11 is adapted to be inserted into a gap 31 between a horizontal ceiling panel 33 having an exposed horizontal bottom surface 35 and a vertical wallboard partition 37 having a large exposed vertical outer surface 39 and a relatively thin elongate horizontal top surface 41. When the capping flange 15 is inserted into the gap 31, the capping flange 15 rests upon the horizontal top surface 41 of the wallboard partition 37, the stem 13 extends generally along the vertical outer surface 39 of the wallboard partition 37 and the trim flange 17 extends generally along the horizontal bottom surface 35 of the ceiling panel 33.

The trim flange 17 has an upper surface 43 and a lower surface 45. The trim piece's raised shoulder 29 is formed by folding the outer end of the trim flange 17 against itself at approximately a 180° angle, thereby forming an aesthetically pleasing thick outer edge 49. It has been found that a trim flange 17 of approximately ⅞ of an inch, with a shoulder folded back approximately ⅛ of an inch from the outer edge 49, provides the desired aesthetically pleasing appearance.

The upper layer 19 of the capping flange 15 extends opposite the trim flange 17 at an angle of approximately 180°, with the trim flange 17 and the upper layer 19 of the capping flange 15 forming a continuous planar strip. The end of the capping flange 15 opposite the trim flange 17 is turned over downward against itself forming an included angle of approximately 180°, with the lower layer 21 of the capping flange 15 extending along the bottom of the upper layer 19 of the capping flange 15 toward the trim flange 17. Thus, it will be appreciated that the capping flange 15 has the general configuration of a sideways "U," with an open end 51 facing towards the trim flange 17 and a closed end 53 opposite the trim flange 17.

Immediately beneath the junction 27 of the upper layer 19 of the capping flange 15 and the trim flange 17, the lower layer 21 of the trim flange 17 is integrally joined to the downwardly curved horizontal lip 22. The lip has an upper portion 55 of the lip 22 which curves downward and backward toward the closed end 53 of the capping flange 15 along a radius of approximately 0.04 inch for approximately 120° , and a lower portion 56 for which the radius of curvature is opposite the upper portion 55 along a gradually increasing radius until it integrally joins the upper end 23 of the planar stem 13 approximately 0.07 inch-below the upper surface 43 of the lower layer 21 of capping flange 15.

Figure 2:
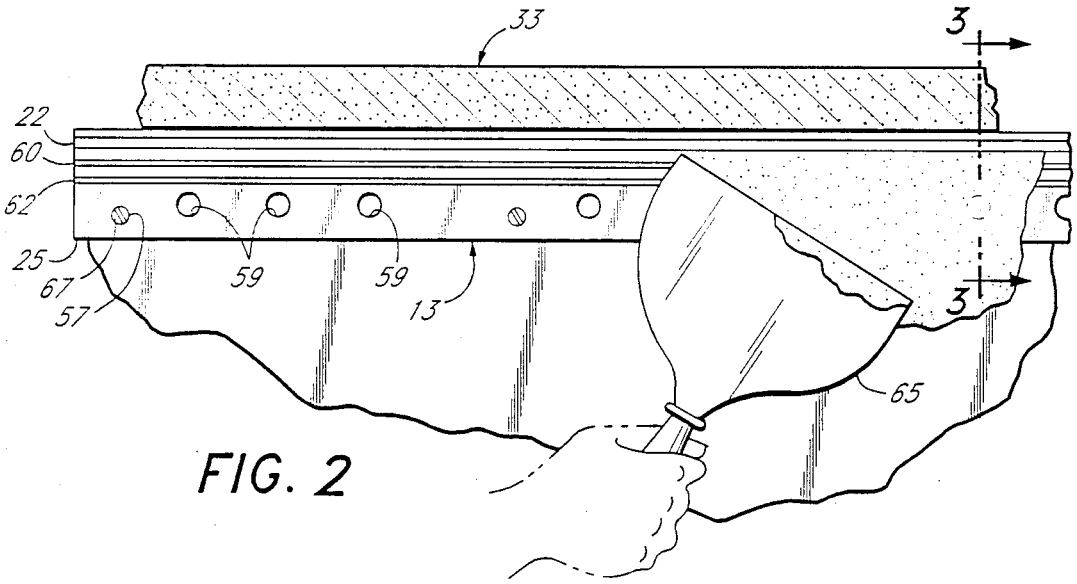
FIG. 2 is a front elevational view illustrating the masking of the trim piece of FIG. 1.

Referring now to FIGS. 1–3, the stem 13 has an inward surface 56 which faces the lower layer 21 of the capping flange and an outward surface 58 which faces the lower surface 45 of the trim flange. The stem 13 includes a first series of smaller apertures 57 positioned near the distal end 25 of the stem 13 for receiving fasteners for securing the trim piece 11 to a wallboard partition 37, and a second series of larger apertures 59 spaced towards the lip 22 from the first set of apertures for receiving masking compound. Specifically, experience has shown that the first series of apertures 57 may have a diameter of approximately ⅛-and be spaced 2/10-inch from the lower edge 33 of the stem 13 and 9⅜ inches from one another. The second series of apertures 59 of apertures may then be formed by groups of three 0.25-inch diameter apertures, centered approximate 0.3125 of an inch from the lower edge 33 of the stem 13 with their centers spaced 1½ inches apart. In the illustrated embodiment, one of the apertures in each group of three is spaced approximately 11/16 of an inch from the center of one of the first series of apertures 57 and each group of three apertures is spaced approximately 6 inches from one another.

In addition, an important aspect of the invention is the provision of an upper bead 60 and a lower bead 62 extending horizontally between the upper end of the stem and the lower end of the stem parallel to the plane of the trim flange. The beads are formed by the plastic deformation of the stem inward along the length of the bead to form a generally V-shaped ridge along the inward surface 56 of the stem and a generally V-shaped depression along the outward surface 58 of the stem. The working or stress hardening of the stem in this manner has the effect of strengthening the stem and increasing the capacity of the trim piece to resist bending and twisting forces.

Advantageously, the trim piece 11 is of unitary construction, so that the stem 13, the capping flange 15, the trim flange 17 and the shoulder 29 are formed of a single sheet of 28 gauge cold rolled steel sheet of substantially homogeneous strength and thickness. When such a gauge of sheet is used, experience has shown that the desired increased strength can be obtained through the formation of a lower bead 62 spaced 2/10 of an inch above the center of the second series of apertures and an upper bead 60 spaced ¼ of an inch above the lower bead 62, with the depth of the bead from the outward surface 58 of the stem equalling 0.018 inch and the radius of curvature of the raised ridge on the inward surface 56 of the stem equalling 0.012 inch.

After the formation of the apertures and beads, but prior to the bending of the trim piece to form the trim flange and capping flange, the sheet is run through an acid bath to ensure the proper bonding of paint to the surface of the metal. Next the side of the sheet corresponding to the upper surface of the trim flange and the inward side of the stem is painted with a rust retardant. After the rust retardant has been applied, the side of the sheet corresponding to the exposed lower surface 45 of the trim flange 17 and the outward surface 58 of the stem is painted with a layer of flexible waxless paint 47, chosen to coordinate with the color of the outer surface 39 of the wallboard partition 37. The painting of the metal sheet has proven to be much quicker and easier than painting the formed trim piece.

The trim piece 11 is provided with a strip 61 of protective low tack tape, extending from the junction between the trim flange and the upper layer of the capping flange to the outer edge 49 of the trim flange 17. The strip 61 is adhesively applied in a manner well known in the art so that it will adhere to the lower surface 45 of the trim flange 17 unless it is physically torn away. The strip 61 protects the trim flange 17 from damage prior to installation and catches any paint 47 or masking compound which splatters over the lip 22 during the installation process.

The installation of the trim piece 11 will now be described with reference to FIGS. 2 and 3. As best seen in FIG. 3, the capping flange 15 is inserted into the gap 31 between the vertical wallboard partition 37 and the horizontal ceiling panel 33 until the distal end 25 of the stem 13 contacts the wallboard partition 37 and the lower layer 21 of the capping flange 15 will rests upon the top surface 41 of the wallboard partition 37. Effectively, this results in three thicknesses of metal covering the gap 31: (1) the lower layer 21 of the capping flange 15; (2) the upper layer 19 of the capping flange 15 and the trim flange 17; and (3) the raised shoulder 29 of the trim flange 17.

The design of the trim piece 11 is such, however, that the capacity of the trim piece 11 to cover a gap 31, is not limited by the number of layers of metal available. Once the trim piece 11 has been inserted sufficiently far into the gap 31 so that the distal end 25 of the stem 13 contacts the wallboard partition 37, suitable fasteners 67, such as screws, are inserted through the first series of apertures 57 to secure the trim piece 11 to the partition 37. The tightening of these fasteners 67 draws the upper end 23 of the stem 13 towards the partition 37 and, due to the 95° angle between the trim flange 17 and the stem 13, forces the trim flange 17 to incline upward from the gap 31 so that the painted lower surface 45 of the trim flange 17 covers the gap 31 from view.

As the following discussion will illustrate, the unique design of the trim piece maximizes the capacity of the trim piece to cover the gap 31. For example, the position of the first series of apertures 57 along the distal end 25 of the stem 13 effectively maximizes the moment applied to the lip 22 by effectively maximizing the moment arm of the force being applied. The upper and lower beads 60, 62 of the stem resist the bending of the stem and ensure the transmission of the full effect of this force to the lip. The lip 22, in turn, transmits this rotational force to the closed end 53 of the capping flange 15, driving the capping flange 15 against the top surface 41 of the wallboard partition 37. As this force is again applied with the greatest possible moment arm, the moment is again maximized. The extra bending and working of the metal of the trim piece 11 at the lip 22 stiffens the trim piece 11 at this point, thereby increasing the capacity of the lip 22 to drive the lower layer 21 of the capping flange 15 downward against the top of the wallboard partition 37.

The driving downward of the closed end 53 of the capping flange 15 against the top surface 41 of the wallboard partition 37, forces the raised shoulder 29 of the trim piece 11 upward against the bottom surface 35 of the ceiling panel 33. As with the stem 13 and the lower layer 21 of the capping flange 15, the force is transmitted over effectively the entire length of the upper layer 19 of the capping flange 15 and the trim flange 17, thereby effectively maximizing the moment applied.

A significant feature of the present design is that junction 27 of the upper layer 19 of the capping flange 15 and the trim flange 17 is at least as strong as the trim flange 17 itself so that any tendency of the junction 27 between the upper layer 19 of the trim flange 17 and the capping flange 15 to bend or buckle will be minimized. Thus, the upper layer 19 of the capping flange 15 and the trim flange 17 are of substantially uniform strength and thickness across the junction 27. This is important because the size of the gap 31 between the wallboard partition 37 and the ceiling panel 33 typically varies over the length of the trim piece 11. While one portion of the trim flange 17 will be bowed concave downward by the force of the bottom surface 35 of the ceiling panel 33 against the raised shoulder 29, another portion of the trim flange 17 must extend upward to form an obtuse included angle with the exposed vertical outer surface 39 of the wallboard partition 37 to cover the entire gap 31 between the wallboard partition and the ceiling panel.

Since the trim flange forms a 180° angle with the upper layer of the capping flange, the amount which the capping flange must force the trim flange upward is diminished. Although the trim piece could be made with an acute angle between the upper layer of the capping flange and the upper surface of the trim flange, an angle of 180° has been found to provide the optimum balance between increased coverage and ease of manufacture. Furthermore, the use of flexible paint to cover the trim flange prevents aesthetically undesirable cracking of the paint as a result of the bending and twisting of the trim flange.

Since the trim flange 17 extends 180° from the upper layer 19 of the capping flange 15, there will often be substantial downward forces on the outer edge 49 of the trim flange 17 when the gap 31 between the wallboard partition 37 and the ceiling panel 33 is relatively narrow. However, since the junction 27 between the trim flange 17 and the upper layer 19 of the capping flange 15 is as strong (i.e., resistant to bending and shearing forces) as the trim flange 17 itself, the trim flange 17 can be reinforced at this junction 27 by the capping flange 15, which acts as a fulcrum supporting a lever.

It is an important feature of the invention that the trim piece 11 not only uses the force of the stem's fasteners 67, applied over a long moment arm, to drive the closed end 53 of the capping flange 15 against the top surface 41 of the wallboard partition 37, but also, as the lower layer 21 of the capping flange 15 and the stem 13 are separated, the resilient lip 22 pulls the closed end 53 of the capping flange 15 downward with increasing strength. The lip 22 not only pulls the closed end 53 of the capping flange 15 against the upper surface 43 of the wallboard partition 37, it also pulls the distal end 25 of the stem 13 against the vertical outer surface 39 of the wallboard partition 37. This is important, because the "snugging up" of the distal end 25 of the stem 13 against the wallboard partition 37, and the slight acute angle formed between the stem 13 and the vertical surface of the wallboard partition 37 facilitates the masking of the stem 13.

The importance of this angle in the masking of the stem 13 will be described with reference to FIGS. 2 and 3. After the fasteners 67 are tightened, a masking compound 63 is applied to the trim piece 11 with a trowel 65 or other suitable applicator. The angle formed between the stem 13 and the vertical surface of the wallboard partition 37 accentuates the lower portion 56 of the lip 22 of the trim piece 11 to provide a convenient guide for the trowel to help minimize the splattering of masking compound. More importantly, however, the angle facilitates the application of a thicker layer of masking compound over the stem 13 through the use of the lip 22 and the outer surface 39 of wallboard partition 37 as guides for a trowel so that the stem 13 and the fasteners 67 are completely concealed by the masking compound. Furthermore, since the angle has the effect of spacing the stem 13 from the wallboard partition 37, masking compound is able to seep into the space between the stem 13 and the vertical outer surface 39 of the wallboard partition 37 to better anchor the masking compound to the trim piece 11. Finally, the use of waxless paint on the stem ensures the formation of a secure bond between the masking compound and the outward surface 58 of the stem 13.

Referring to FIG. 3, the masking compound will typically be covered by a cosmetic layer such as paint 47 or wallpaper. The protective strip 61 covers the trim piece 11 during this part of the installation process, to protect the finish of the trim piece 11 from damage. After the cosmetic layer has dried, the strip 61 is torn downward, exposing the entire unblemished, aesthetically pleasing painted lower surface of the trim flange 17.

Together the unique combination of structural features of the trim piece 11 virtually ensure the covering of unsightly gaps between wallboard partitions and ceiling panels, while providing an aesthetically pleasing, unblemished appearance.

I claim:

1. A ceiling trim system, comprising:

a substantially vertical wallboard partition having a substantially vertical outer surface and a substantially horizontal top surface;

a substantially horizontal ceiling panel having a horizontal bottom surface, said top surface of said wallboard partition and said bottom surface of said ceiling panel forming a gap between one another; and a metal trim piece insertable into said gap for purposes of covering said gap and providing an aesthetically pleasing trim strip along said partition, comprising:

a generally horizontal capping flange turned downward against itself creating an upper layer and a lower layer insertable into said gap, said upper and said lower layer forming a sideways "U" with an included angle of approximately 180°, said sideways "U" including an open end and closed end;

a generally horizontal trim flange having a painted lower surface which forms an angle of approximately 180° with said upper layer of said capping flange, said trim flange and said capping flange integrally joined along a junction which is at least as strong as said trim flange to form a continuous planar strip, said trim flange including a raised shoulder opposite said capping flange which forms an outer edge;

a generally vertical stem having an upper end and a lower end; and an elongate horizontal lip having an upper portion and a lower portion providing a guide for the application of masking compound over said stem, said upper portion being integrally joined with said lower layer of said capping flange and said lower portion being integrally joined with said upper end of said stem, said stem forming an included obtuse angle with said trim flange which facilitates the application of masking compound over said stem.

2. The ceiling trim system of claim 1, further comprising:

a strip removably adhesively secured to said painted lower surface of said trim flange to protect said trim flange during installation of said trim piece.

3. The ceiling trim system of claim 1, wherein said stem of said trim piece further comprises a series of apertures spaced from said lower end of said stem for receiving and retaining masking compound.

4. The ceiling trim system of claim 3, wherein said stem of said trim piece further comprises a raised bead extending parallel to said trim flange between said upper end and said lower end of said stem for increasing the capacity of said trim piece to resist twisting moments.

5. A metal trim piece, insertable into a gap between a vertical wallboard partition and a horizontal ceiling panel, comprising:

a generally horizontal capping flange turned downward against itself creating an upper layer and a lower layer which form a sideways "U" with an included angle of approximately 180 degrees, said sideways "U" including an open end and a closed end;

a generally horizontal trim flange having a painted lower surface which forms an angle of approximately 180 degrees with said upper layer of said capping flange, said trim flange and said capping flange integrally joined along a junction which is at least as strong as said trim flange to form a continuous planar strip, said trim flange including a raised shoulder opposite said capping flange which forms an outer edge;

a generally vertical stem having an upper end and a lower end, said stem including a raised bead extending parallel to said trim flange between said upper end and said lower end of said stem for increasing the capacity of said trim piece to resist twisting moments; an elongate horizontal lip having an upper portion and a lower portion providing a guide for the application of masking compound over said stem, said upper portion being integrally joined with said lower layer of said capping flange and said lower portion being integrally joined with said upper end of said stem, said stem forming an included obtuse angle with said trim flange which facilitates the application of masking compound over said stem; and a strip removably adhesively secured to said painted lower surface of said trim flange to protect said trim flange during installation of said trim piece.

6. The trim piece of claim 5, wherein said stem further comprises a series of apertures spaced from said lower end of said stem for receiving and retaining masking compound.

* * * * *